US009173812B2

(12) United States Patent
Chabanol et al.

(10) Patent No.: US 9,173,812 B2
(45) Date of Patent: Nov. 3, 2015

(54) PACKAGING FOR UNIT PHARMACEUTICAL PRODUCTS

(75) Inventors: Stephane Chabanol, Paris (FR); Guillaume Despins, Paris (FR); Sophie Drexler, Paris (FR); Stephanie Gaste, Paris (FR); Francois Marin, Paris (FR)

(73) Assignee: SANOFI, Paris (FR)

( * ) Notice: Subject to any disclaimer, the term of this patent is extended or adjusted under 35 U.S.C. 154(b) by 0 days.

(21) Appl. No.: 14/004,263

(22) PCT Filed: Mar. 16, 2012

(86) PCT No.: PCT/FR2012/050561

§ 371 (c)(1),
(2), (4) Date: Sep. 10, 2013

(87) PCT Pub. No.: WO2012/123689

PCT Pub. Date: Sep. 20, 2012

(65) Prior Publication Data

US 2014/0001077 A1 Jan. 2, 2014

(30) Foreign Application Priority Data

Mar. 17, 2011 (FR) ..... 11 52202

(51) Int. Cl.

| | |
|---|---|
| ***B65D 83/04*** | (2006.01) |
| ***B65D 85/42*** | (2006.01) |
| ***A61J 1/03*** | (2006.01) |
| ***B65D 75/32*** | (2006.01) |
| *A61J 1/14* | (2006.01) |

(52) U.S. Cl.

CPC ..... *A61J 1/035* (2013.01); *B65D 75/327* (2013.01); *A61J 1/1412* (2013.01); *B65D 2575/586* (2013.01)

(58) Field of Classification Search

USPC ..... 206/528, 531, 532, 538, 467, 469

See application file for complete search history.

(56) References Cited

U.S. PATENT DOCUMENTS

| | | | | |
|---|---|---|---|---|
| 7,866,476 | B2 * | 1/2011 | McGonagle et al. | 206/535 |
| 2007/0205133 | A1 | 9/2007 | Valentine et al. | |
| 2007/0227931 | A1 * | 10/2007 | Shane | 206/528 |

(Continued)

FOREIGN PATENT DOCUMENTS

| | | | |
|---|---|---|---|
| DE | 81 10 654 | U1 | 7/1981 |
| DE | 38 32 083 | A1 | 3/1990 |

(Continued)

OTHER PUBLICATIONS

International Search Report dated Jul. 2, 2012 issued in PCT/FR2012/05061.

*Primary Examiner* — Jacob K Ackun

(74) *Attorney, Agent, or Firm* — Scully, Scott, Murphy & Presser, P.C.

(57) ABSTRACT

The invention relates to a packaging for unit pharmaceutical products, comprising: a receiving element (3) having at least one cell (7) defining an inner space (9) configured so as to receive such a product (2) and an opening (9) to said space; an element (10) for covering said cell, fixed to said receiving element in the region of the opening and designed so as to be torn or removed in order to extract said product; and a repositionable temporary closing body (22) designed such that it occupies a determined initial position from which it can be removed and at least one temporary closing position wherein it is temporarily fixed by adhesion to said element around said opening to the space of said previously opened cell; said determined initial position being separate from said closing position and said temporary closing body having an at least partially pre-glued closing part (23).

16 Claims, 3 Drawing Sheets

(56) References Cited

U.S. PATENT DOCUMENTS

Figure 1:
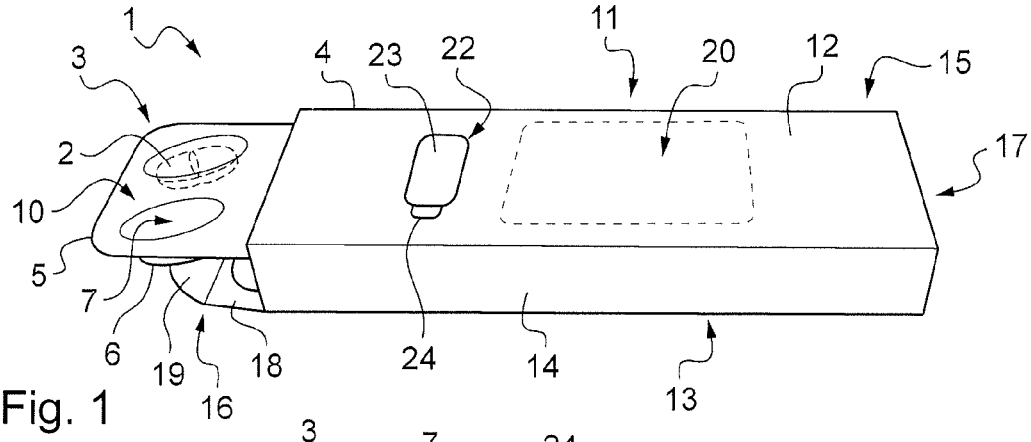

| | | | | |
|---|---|---|---|---|
| 2008/0060968 | A1* | 3/2008 | Levy | 206/531 |
| 2008/0190809 | A1* | 8/2008 | Simon et al. | 206/532 |

FOREIGN PATENT DOCUMENTS

| | | | |
|---|---|---|---|
| DE | 20 2004 006275 | U1 | 6/2004 |
| EP | 0 712 790 | A1 | 5/1996 |

* cited by examiner

PACKAGING FOR UNIT PHARMACEUTICAL PRODUCTS

The invention relates to packaging for unit pharmaceutical products.

The invention also relates to methods for taking at least one unit pharmaceutical product.

Packaging for pharmaceutical products, comprising a receiving element, also known as a blister pack, having a number of cells that each define an internal space configured to accommodate a pharmaceutical product, and an orifice that opens into each internal space, is known. A covering element is fixed to this blister pack in order to cover the cells. The covering element, generally formed from a thin aluminum sheet, is disposed in the region of the orifices and is configured to be torn or removed in order to extract the pharmaceutical product located in the cell, for example through the action of a patient wishing to consume only a fraction of the pharmaceutical product. The cell is then opened as a result of the tearing or the removal of a part of the aluminum sheet forming a membrane seal.

If the patient reintroduces the remaining fraction of the pharmaceutical product into the cell in which it was initially located, there is a risk that this remaining fraction will escape from the cell and that the patient will lose it.

The invention aims to provide a packaging that solves the problem mentioned above and which is simple, convenient and economical.

Thus, in a first aspect, the subject of the invention is a packaging for unit pharmaceutical products, comprising an element for receiving at least one unit pharmaceutical product, having at least one cell defining an internal space configured to accommodate said at least one unit pharmaceutical product and an orifice opening into said internal space; and an element for covering said cell, said element being fixed to said receiving element in the region of said orifice and being configured to be torn or removed in order to extract the pharmaceutical product disposed in said cell, said cell then being open; characterized in that it comprises a repositionable temporary closure member configured such that it has a predetermined initial position from which it can be withdrawn and at least one temporary closure position in which said closure member is temporarily fixed to said receiving element around said orifice into which said internal space of said previously opened cell opens; said predetermined initial position being different than said at least one closure position, and said temporary closure member has a closure portion at least partially coated with adhesive.

By virtue of the invention, a patient who wishes to consume only a fraction of a unit pharmaceutical product present in the internal space of the cell has the possibility of safely keeping the unconsumed fraction of the pharmaceutical product in the same internal space as was initially provided for the entire pharmaceutical product. For this purpose, it is sufficient for the patient to introduce the unconsumed fraction of the pharmaceutical product into the internal space of the cell, to remove the repositionable temporary closure member from its predetermined initial position and to reposition this temporary closure member in its temporary closure position, in other words facing this same cell and this same fraction of unconsumed pharmaceutical product, around the orifice.

The temporary closure member forms a temporary membrane seal disposed in the place of another initial membrane seal formed by the covering element.

The packaging according to the invention thus has a secure structure which is simple and convenient, both in terms of design and in terms of use.

According to preferred, simple, convenient and economical characteristics of the packaging according to the invention:

- said closure portion is provided with at least one zone coated with adhesive and at least one zone not coated with adhesive;
- said zone coated with adhesive has an annular shape and said zone not coated with adhesive has a rectangular shape;
- said zone not coated with adhesive is central over the closure portion;
- said zone coated with adhesive surrounds said zone not coated with adhesive;
- said zone coated with adhesive has the shape of a rectangular ring having a width in the range [10 mm; 25 mm], a length in the range [20 mm; 35 mm] and a thickness in the range [1 mm; 10 mm];
- said zone not coated with adhesive has a width in the range [5 mm; 20 mm] and a length in the range [10 mm; 30 mm];
- said zone coated with adhesive and said zone not coated with adhesive are configured such that the area of the zone coated with adhesive represents about 25% to about 75% of the area of the closure portion;
- said packaging comprises an inserted protective sheet covering said zone not coated with adhesive in said predetermined initial position of said closure member;
- said temporary closure member comprises a gripping portion protruding from the closure portion;
- said gripping portion is not coated with adhesive;
- said gripping portion has a width in the range [2 mm; 10 mm] and a length in the range [5 mm; 20 mm];
- the portion coated with adhesive is provided with a food-grade adhesive;
- said temporary closure member is disposed on said element for receiving at least one pharmaceutical product when said temporary closure member is in its predetermined initial position; and
- said packaging comprises a box intended to accommodate said element for receiving at least one pharmaceutical product, said temporary closure member being disposed on said box when said temporary closure member is in its predetermined initial position.

In a second aspect, the subject of the invention is also a method for taking at least one unit pharmaceutical product as described above which is disposed in the internal space of a cell of a receiving element of a packaging, comprising the following steps of:

- extracting said at least one unit pharmaceutical product from said receiving element by tearing or removing a covering element fixed to said receiving element in the region of an orifice into which said internal space of said cell opens, the cell then being open;
- dividing said unit pharmaceutical product into a number of fractions, with at least one fraction being intended to be taken and at least one other fraction being intended to be kept;
- placing said fraction to be kept back into said previously opened cell;
- removing a repositionable temporary closure member of said packaging from its predetermined initial position; and
- repositioning said repositionable temporary closure member in its temporary closure position in which said closure member is temporarily fixed to said receiving element around said orifice into which said internal space of said previously opened cell opens; said closure position being different than said predetermined initial position.

The method according to the invention is particularly simple and convenient to implement.

Figure 2:
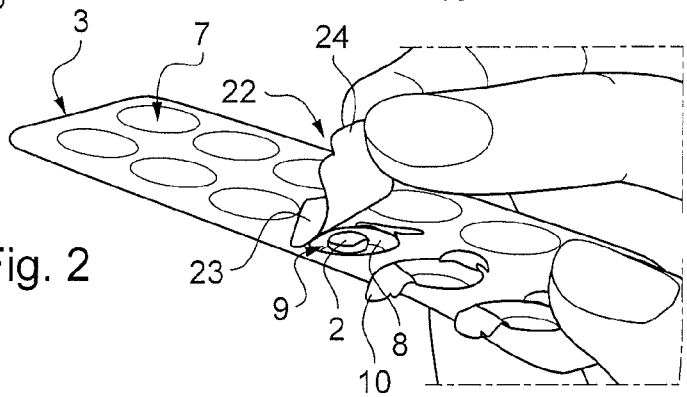
Figure 3:
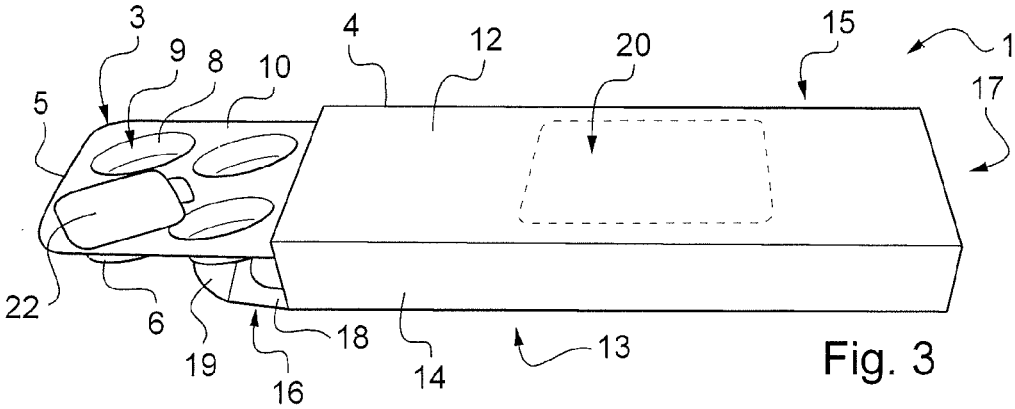
Figure 5:
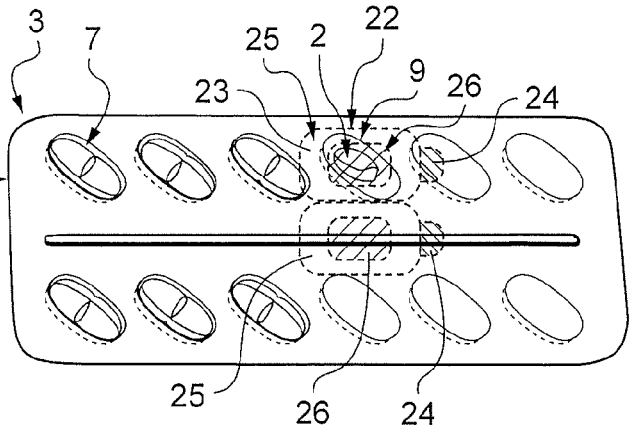
Figure 4:
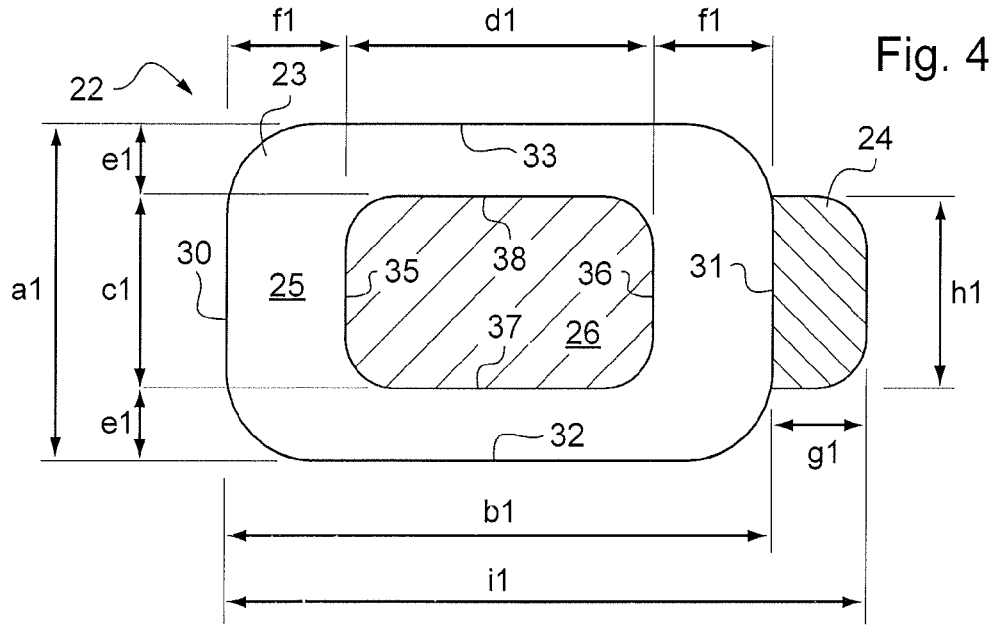
Figure 6:
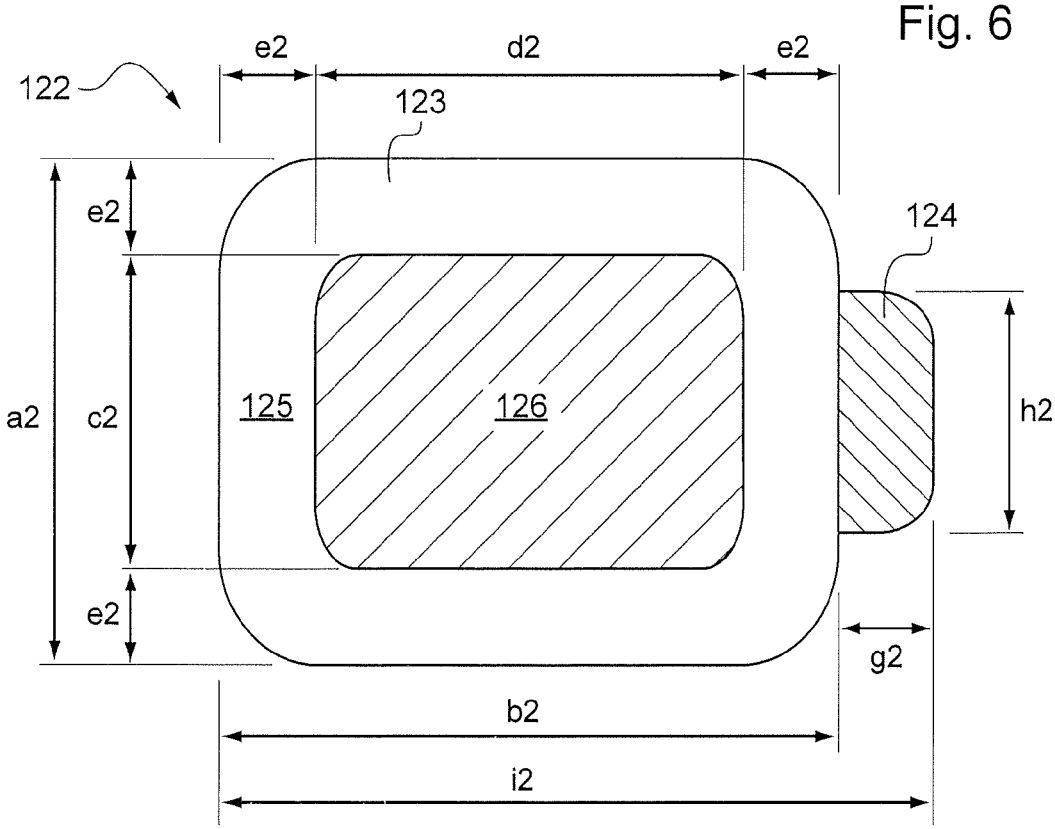
Figure 7:
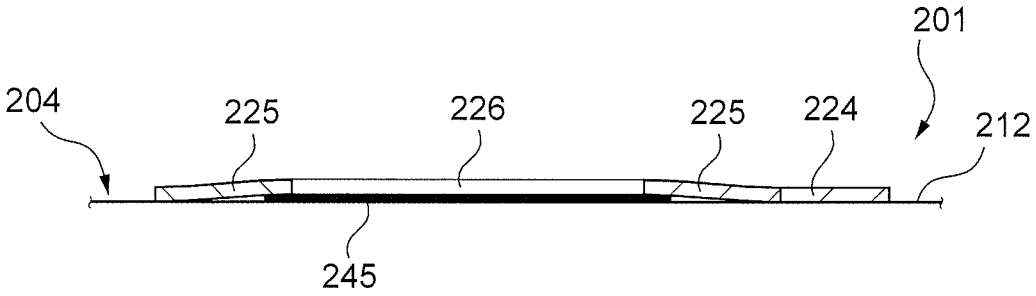
Figure 8:
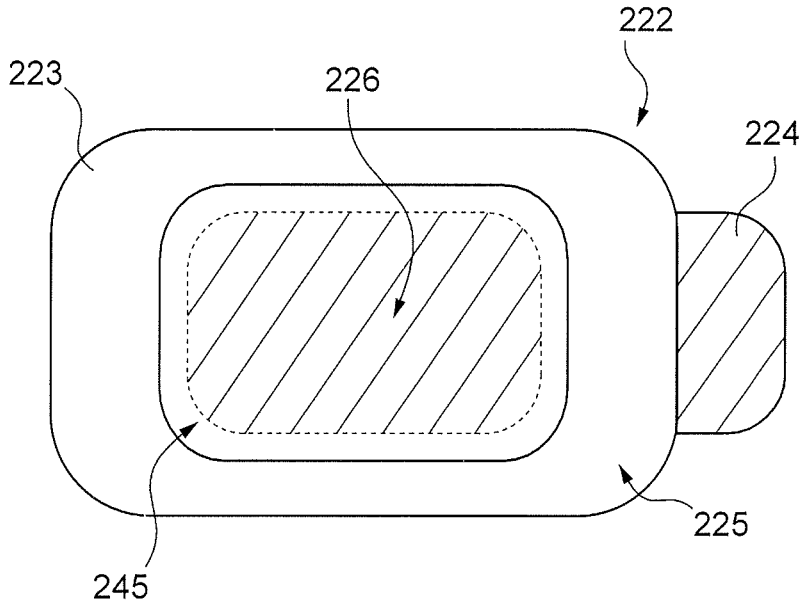

The exposition of the invention will now be continued with the description of an exemplary embodiment, given below in an illustrative and nonlimiting manner, with reference to the appended drawings, in which:

FIG. 1 schematically shows a perspective view of a packaging in accordance with the invention, comprising a box from which an element for receiving at least one pharmaceutical product has been partially removed and on which a repositionable temporary closure member is disposed;

FIG. 2 schematically shows a perspective view of a user in the course of repositioning the temporary closure member from FIG. 1 on said receiving element of FIG. 1;

FIG. 3 is a view similar to that of FIG. 1 except that the temporary closure member is positioned on the receiving element;

FIG. 4 schematically shows the temporary closure member of FIGS. 1 to 3 in isolation;

FIG. 5 schematically shows a perspective view of a packaging in accordance with a second embodiment of the invention;

FIG. 6 is a similar view to that of FIG. 5 but for a variant embodiment of the closure member;

FIG. 7 schematically shows a partial view of a packaging in accordance with a third embodiment of the invention; and FIG. 8 schematically shows the temporary closure member of FIG. 7 in isolation.

FIG. 1 illustrates a packaging 1 for unit pharmaceutical products 2 (shown by way of dashed lines) in a blister pack 3, which is suitable for insertion into and withdrawal from a box 4 forming this package 1.

The unit pharmaceutical products 2 are generally in the form of gel capsules, tablets or granules.

These unit pharmaceutical products 3 can be divided into a number of fractions.

These pharmaceutical products 2 are packaged into the blister pack 3 which forms a receiving element and which comprises a plastics base 5 having protuberances 6 which each form a cell 7 defining an internal space 8 configured to accommodate a pharmaceutical product 2.

The internal space 8 of each cell 7 opens into an orifice 9.

Each cell 7 has in this case an oblong contour and a dish-shaped base.

The blister pack 3 comprises a covering element 10 formed by a film, which in this case is metal, for example made of aluminum, covering the bottom of the base 5, that is to say being disposed in the region of the orifices 9 in order to close each cell 7 in order to keep the pharmaceutical products 2 inside these cells 7.

Thus, the metal film forms a plurality of membrane seals in each case for one cell 7.

This metal film is sufficiently thin for easy extraction of each unit pharmaceutical product 2 by tearing this film under the action of an external force for extraction of the unit pharmaceutical product 2.

The box 4 has an enclosure 11 formed by an upper face 12, a lower face 13 opposite to the upper face 12, a front face 14 and a bottom face 15 opposite to the front face 14.

The upper face 12 is opposite the lower face 13 in a substantially parallel manner and the front face 14 is likewise opposite the bottom face 15 in a substantially parallel manner.

This box 4 also has a first flap 16 for opening/closing this box 4 and a second flap 17 for opening/closing this box 4.

These first and second flaps 16 and 17, in a closed configuration, close off the space delimited inside the box 4 by the enclosure 11, with this space being partially occupied by pharmaceutical products 2 in a blister pack 3 and by instructions for use (not shown).

The first and second flaps 16 and 17 are hinged to the lower face 13 by a respective edge.

In their closed configuration, the first and second flaps 16 and 17 are thus arranged opposite one another, in an approximately parallel manner.

In FIGS. 1 and 3, the flap 17 is in its closed configuration while the flap 16 is in an open configuration.

This flap 16 has a side wall 18 attached by a first end to the lower face 13 and a tab portion 19 attached by one end to a second end of the side wall 18, said second end of the wall 18 being opposite to the first end of this wall 18.

The tab portion 19 is suitable for insertion into the interior space of the box 4 when the flap 16 is in its closed configuration.

This box 4 is produced from cardboard material and is formed in one piece by being cut out of a cardboard blank.

This box 4 furthermore has, on its upper face 12, a first zone intended to receive a self-adhesive sticker 20 on which administrative information is given which is useful for example for reimbursement for the pharmaceutical products 2 included in the box 4.

This box 4 has a repositionable temporary closure member 22, in this case in the form of a label disposed by adhesion on a second zone of the upper face 12 of the box 4.

In FIG. 1, the repositionable temporary closure member 22 is in a predetermined initial position from which it can be removed by unsticking.

This temporary closure member 22, also called label, has a closure portion 23 and a gripping portion 24 protruding from the closure portion 23.

FIG. 3 is similar to FIG. 1, except that the closure member 22 is repositioned on the blister pack 3 in the region of an orifice 9 of a previously opened cell 7.

This closure member 22 thus forms a membrane seal that seals this orifice 9.

The closure member 22 is thus in a temporary closure position which is different than the predetermined initial position illustrated in FIG. 1.

The steps to be carried out for transferring the closure member 22 from its predetermined initial position (FIG. 1) to its temporary closure position (FIG. 3) will be shown in detail below.

The closure member 22 will now be described in detail with reference to FIG. 4.

The closure portion 23 of this member 22 has a zone 25 coated with adhesive and a zone 26 not coated with adhesive.

The zone 25 coated with adhesive has in this case a rectangular annular shape (the corners of which are rounded) and the zone 26 not coated with adhesive has in this case a rectangular shape (the corners of which are also rounded) located centrally in the closure portion 23.

The zone 25 coated with adhesive surrounds the zone 26 not coated with adhesive.

The zone 25 coated with adhesive has a first side 30, a second side 31 opposite to the first side 30, a third side 32 and a fourth side 33 opposite to the third side 32.

The zone 25 coated with adhesive is provided with a food-grade adhesive.

The zone 26 not coated with adhesive has a first side 35, a second side 36 opposite to the first side 35, a third side 37 and a fourth side 38 opposite to the third side 37.

The zone 26 not coated with adhesive is intended to be disposed opposite the orifice 9 of a previously opened cell 7 of the blister pack 3 when a patient positions the closure member 22 in its temporary closure position.

The zone 25 coated with adhesive and the zone 26 not coated with adhesive each have an external contour having the same general shape.

The external contour of the zone 26 not coated with adhesive coincides with the internal contour of the zone 25 coated with adhesive.

Thus, the first sides 30 and 35, respectively, of the zone 25 coated with adhesive and the zone 26 not coated with adhesive are disposed opposite one another, the second sides 31 and 36, respectively, of the zone 25 coated with adhesive and the zone 26 not coated with adhesive are disposed opposite one another, the third sides 32 and 37, respectively, of the zone 25 coated with adhesive and the zone 26 not coated with adhesive are disposed opposite one another and the fourth sides 33 and 38, respectively, of the zone 25 coated with adhesive and the zone 26 not coated with adhesive are disposed opposite one another.

In the example illustrated, the zone 25 coated with adhesive has a width a1 approximately equal to 14 mm, a length b1 approximately equal to 23 mm, a first thickness e1 (along its length b1) approximately equal to 3 mm and a second thickness f1 (along its width a1) approximately equal to 5 mm.

The zone 26 not coated with adhesive has a width c1 approximately equal to 8 mm and a length d1 approximately equal to 13 mm.

Thus, the zone 25 coated with adhesive extends over an area that represents about 32% of the area of the closure portion 23.

The gripping portion 24 extends in a manner protruding from the second side 31 of the zone 25, coated with adhesive, of the closure portion 23.

This gripping portion 24 is not coated with adhesive.

The gripping portion 24 has in this case an approximately rectangular shape (two free corners of which are rounded) and is not coated with adhesive.

In the example illustrated, the gripping portion 24 has a width h1 approximately equal to 8 mm, like the width c1 of the zone 26 not coated with adhesive, and a length g1 approximately equal to 4 mm.

The closure member 22 thus has an overall length i1 approximately equal to 27 mm and a width corresponding to the width a1 of the zone 25 coated with adhesive, which is approximately equal to 14 mm.

The steps for repositioning the closure member 22 from its predetermined initial position into its temporary closure position will now be described with reference to FIGS. 1 to 3.

When the patient only desires to take a fraction of the unit pharmaceutical product 2, he removes the blister pack 3 from the box 4, presses on a protuberance 6 in order to push the unit pharmaceutical product 2 against the portion of the metal film 10 in the region of the orifice 2 until this portion of metal film 10 tears and extracts the unit pharmaceutical product 2.

The patient then breaks the unit pharmaceutical product 2 into a number of fractions, at least one of which is intended to be kept and the other of which is intended to be consumed.

The patient reintroduces the unconsumed fraction of the pharmaceutical product 2 into the internal space 8 of the previously opened cell 7.

In this configuration, the unconsumed fraction of the divided pharmaceutical product 2 is free to escape from this cell 7.

The patient takes hold of the gripping portion 24 of the closure member 22 and unsticks the closure portion 23 of this closure member 22 from the upper face 12 of the box 4.

The closure member 22 is then removed from its predetermined initial position.

Next, the patient repositions the closure member 22 on the bottom of the base 5 of the blister pack 3 in the region of the orifice 9 of the previously opened cell, in which the unconsumed fraction of the divided pharmaceutical product 2 is disposed (FIG. 2), in order to close the internal space 8 of this cell 7 again.

The closure element 22 is then in a temporary closure position on the blister pack 3.

In this temporary closure position, the closure member 22 is fixed to the blister pack 3 by adhesion.

This closure member 22 is disposed such that it completely covers the orifice 9 of the cell 7, in order to prevent the remaining fraction of the pharmaceutical product 2 from escaping.

The closure member 22 is disposed approximately in the same direction as the longitudinal direction of the cell 7, in this case at an angle with respect to the longitudinal edges of the base 5 of the blister pack 3.

The patient can then reintroduce the blister pack 3 into the box 4 with the remaining fraction of the pharmaceutical product 2 which is kept safe.

Of course, the patient can then unstick the temporary closure member 22 again in order to take the remaining fraction of the pharmaceutical product 2 and can reposition the temporary closure member 22 on the box 4 by adhesion or put it back in its temporary closure position, as desired.

In addition, the patient can unstick this closure member 22 once again if he is taking only a fraction of another unit pharmaceutical product, and secure the remaining fraction by repositioning the closure member 22 opposite the new opened cell.

These steps can be repeated a number of times.

FIG. 5 illustrates a packaging similar to the packaging in FIGS. 1 to 3, except that the closure member 22 (which is identical to the closure member in FIGS. 1 to 4) is in a different predetermined initial position than the predetermined initial position of the closure member in FIGS. 1 to 4.

The top of the base 5 of the blister pack 3 can be seen in FIG. 5.

The closure member 22 is shown by way of dashed lines since it is located on the bottom of the base 5 of the blister pack 3.

The closure member 22 is shown in two positions, the one, central position corresponding to its predetermined initial position in which it does not cover an orifice 9, and the other, lateral position corresponding to its temporary closure position in which it covers an orifice 9.

In its predetermined initial position, the closure member 22 is located directly on the blister pack 3, unlike in FIGS. 1 to 3, where the closure member 22 is located, in its predetermined initial position, on the box 4.

The blister pack 3 in FIG. 5 has a central zone suitable for receiving the closure member 22 without the latter inhibiting the extraction of one of the unit pharmaceutical products 2 located in the cells 7 of the blister pack 3.

The closure member 22 is disposed by adhesion on the blister pack 3 by way of its zone 25, coated with adhesive, located on the closure portion 23.

This closure member 22 also has a protruding gripping portion 24 for moving it from its predetermined initial position on the blister pack 3 into the temporary closure position shown in this same FIG. 5.

In this temporary closure position, the closure member 22 is disposed differently compared with FIGS. 2 and 3, since its long sides are approximately parallel to the longitudinal edges of the blister pack 3. The closure member 22 is thus not disposed at an angle.

The remaining fraction of the pharmaceutical product 2 is located opposite the zone 26, not coated with adhesive, of the closure member 22 and this closure member 22 completely covers the orifice 9 of the cell 7 in which the remaining fraction of the pharmaceutical product 2 is located.

FIG. 6 illustrates a closure member 122 according to a variant embodiment of the closure member 22 from FIGS. 1 to 5.

Generally, the same references have been used for similar elements, but raised by 100.

The closure member 122 differs from the closure member 22 only by way of its dimensions.

Specifically, the closure member 122 comprises a closure portion 123 provided with a zone 125 coated with adhesive and a zone 126 not coated with adhesive; and a gripping portion 124 protruding from the closure portion 123.

The zone 125 coated with adhesive has a width a2 approximately equal to 21 mm and a constant thickness e2 along its periphery approximately equal to 4 mm.

The zone 126 not coated with adhesive has a width c2 approximately equal to 13 mm and a length d2 approximately equal to 18 mm.

The gripping portion 124 has a length g2 approximately equal to 4 mm and a width h2 approximately equal to 10 mm.

The closure member 122 thus has an overall length i2 approximately equal to 30 mm and an overall width equal to the width a2 of the zone 125 coated with adhesive, which is approximately equal to 21 mm.

The area of the zone 125 coated with adhesive thus represents about 43% of the area of the closure portion 123.

FIGS. 7 and 8 illustrate a third embodiment of the packaging.

Generally, the same references as those used for the packaging 1 in FIGS. 1 to 4 have been used for similar elements, but raised by 200.

FIG. 7 illustrates a packaging 201 comprising a box 204, a temporary closure member 222 (shown in detail in FIG. 8) and a blister pack (not shown) comprising a plurality of unit pharmaceutical products (not shown).

The box 204 and the blister pack in FIG. 7 are identical to the box 4 and the blister pack 3 in FIGS. 1 to 4.

The closure member 222 in FIGS. 7 and 8 is also identical to the closure member 22 in FIGS. 1 to 4, except that an inserted protective sheet 245 is interposed between this closure member 222 and the upper face 212 of the box 204 in the predetermined initial position of the member 222.

This inserted protective sheet 245 has larger dimensions than the dimensions of the zone 226, not coated with adhesive, (shown by way of dashed lines in FIG. 8) of the closure portion 223 of the member 222.

Thus, the peripheral edge of this sheet 245 is disposed by adhesion on the zone 225, coated with adhesive, of the closure portion 223 of the member 222, such that this sheet 245 covers the zone 226 not coated with adhesive and isolates the latter from impurities which could be present on the box 204.

When the patient unsticks the closure member 222 by pulling on the gripping portion 224, the inserted protective sheet 245 remains attached to the zone 225 coated with adhesive.

The patient thus has to remove this inserted sheet 245 before repositioning the closure member 222 on the blister pack in a position closing a previously opened cell.

Thus, the zone 226 not coated with adhesive, which is in the region of the orifice of the previously opened cell, is clean.

In variants which are not illustrated:

- the repositionable temporary closure member has much greater dimensions, for example close to those of the blister pack;
- the repositionable temporary closure member has a zone coated with adhesive which has a width in the range [10 mm; 25 mm], a length in the range [20 mm; 35 mm], a thickness in the range [1 mm; 10 mm]; and/or a zone not coated with adhesive which has a width in the range [5 mm; 20 mm] and a length in the range [10 mm; 30 mm]; and/or a gripping portion which has a width in the range [2 mm; 10 mm] and a length in the range [5 mm; 20 mm];
- the zone coated with adhesive has a semi-annular shape rather than annular shape and the zone coated with adhesive only partially surrounds the zone not coated with adhesive;
- the zone coated with adhesive of the closure member has an area which represents about 25% to about 75% of the area of the closure portion of the closure member;
- the repositionable temporary closure member is completely coated with adhesive;
- the closure portion of the closure member is completely coated with adhesive and the gripping portion is not coated with adhesive;
- the zone coated with adhesive of the closure member comprises a non-food-grade adhesive;
- the closure member, in its predetermined initial position, is located neither on the upper face of the box nor on the packaging but rather on the lower face of the box or on a set of instructions for use giving in particular the dosage associated with the pharmaceutical products in the packaging, or else on a support sheet inserted freely into the box or stuck (such that it can be unstuck) in the box;
- one face of the inserted sheet is adhesively bonded to the box in the region of the zone for receiving the closure member such that the zone of the latter that is not coated with adhesive is opposite the sheet in its predetermined initial position; and the sheet remains on the box when the patient removes the closure member from its predetermined initial position;
- the two faces of the inserted sheet are coated with adhesive and this sheet has dimensions equal to or larger than those of the zone not coated with adhesive of the closure portion;
- the closure member has a different shape from the closure members 22 and 122 described in FIGS. 1 to 6, for example a circular shape or a lozenge shape;
- the packaging comprises a number of repositionable temporary closure members; and
- the blister pack does not comprise a plastics base and an aluminum film, but is rather produced entirely from a metal material, for example from aluminum, or from plastics material.

It will be noted more generally that the invention is not limited to the examples described and shown.

The invention claimed is:

1. A packaging for unit pharmaceutical products which can be divided into a number of fractions, with at least one fraction being intended to be taken and at least one other fraction being intended to be maintained in said packaging, comprising:

- a receiving element for receiving a plurality of unit pharmaceutical products, said element having a plurality of cells, each cell defining both an internal space configured to accommodate one of said unit pharmaceutical products and an orifice opening into said internal space;

a covering element fixed to said receiving element for covering each of said cells, at least a portion of said covering element being configured to be permanently torn or permanently removed in the region of one of said orifices to extract said unit pharmaceutical product disposed in said cell defining said orifice, thereby opening said cell; and a repositionable temporary closure member having a predetermined initial position, at which position the repositionable temporary closure member is located on the packaging and distanced from all the cells and the orifices associated with the cells, such that the repositionable temporary closure member does not inhibit the extraction of the unit pharmaceutical products located in said cells;

the repositionable temporary closure member being configured to be removed from said predetermined initial position and to be placed in a temporary closure position when a unit pharmaceutical product is extracted from one of said cells by opening said cell and is divided into a number of fractions and when at least one fraction is placed back in said previously opened cell, wherein, when at the temporary closure position, said repositionable temporary closure member is temporarily fixed by adhering to said receiving element around said orifice into which said internal space of said previously opened cell opens;

wherein said repositionable temporary closure member is distinct from said receiving element and said receiving element; said predetermined initial position is different than said temporary closure position; and said repositionable temporary closure member has a closure portion at least partially coated with adhesive.

2. The packaging as claimed in claim 1, wherein said closure portion is provided with at least one zone coated with adhesive and at least one zone not coated with adhesive.

3. The packaging as claimed in claim 2, wherein said zone coated with adhesive has an annular shape and said zone not coated with adhesive has a rectangular shape.

4. The packaging as claimed in claim 2, wherein said zone not coated with adhesive is central over the closure portion.

5. The packaging as claimed in claim 2, wherein said zone coated with adhesive at least partially surrounds said zone not coated with adhesive.

6. The packaging as claimed in claim 2, wherein said zone coated with adhesive has a width in the range of 10 mm to 25 mm, a length in the range of 20 mm to 35 mm and a thickness in the range of 1 mm to 10 mm.

7. The packaging as claimed in claim 2, wherein said zone not coated with adhesive has a width in the range of 5 mm to 20 mm and a length in the range of 10 mm to 30 mm.

8. The packaging as claimed in claim 2, wherein said zone coated with adhesive and said zone not coated with adhesive are configured such that the area of the zone coated with adhesive represents about 25% to about 75% of the area of the closure portion.

9. The packaging as claimed in claim 2, wherein it comprises an inserted protective sheet covering said zone not coated with adhesive in said predetermined initial position of said closure member.

10. The packaging as claimed in claim 1, wherein said temporary closure member comprises a gripping portion protruding from the closure portion.

11. The packaging as claimed in claim 10, wherein said gripping portion is not coated with adhesive.

12. The packaging as claimed in claim 10, wherein said gripping portion has a width in the range of 2 mm to 10 mm and a length in the range of 5 mm to 20 mm.

13. The packaging as claimed in claim 1, wherein the portion coated with adhesive is provided with a food-grade adhesive.

14. The packaging as claimed in claim 1, wherein said temporary closure member is disposed on said element for receiving at least one pharmaceutical product when said temporary closure member is in its predetermined initial position.

15. The packaging as claimed in claim 1, wherein it comprises a box intended to accommodate said element for receiving at least one pharmaceutical product, said temporary closure member being disposed on said box when said temporary closure member is in its predetermined initial position.

16. A method for taking at least one unit pharmaceutical product which is disposed in the internal space of a cell of a receiving element of a packaging for unit pharmaceutical products, the packaging comprising:

an element for receiving at least one unit pharmaceutical product, said element having at least one cell defining an internal space configured to accommodate said at least one unit pharmaceutical product and an orifice opening into said internal space;

an element for covering said cell, said element being fixed to said receiving element in the region of said orifice and being configured to be torn or removed to extract said pharmaceutical product disposed in said cell, thereby opening said cell; and a repositionable temporary closure member, wherein the repositionable temporary closure member is configured such that the repositionable temporary closure member has a predetermined initial position from which the repositionable temporary closure member can be withdrawn and at least one temporary closure position in which said closure member is temporarily fixed by adhering to said receiving element around said orifice into which said internal space of said previously opened cell opens;

wherein said predetermined initial position is different than said at least one closure position; and said temporary closure member has a closure portion at least partially coated with adhesive, the method comprising the following steps of:

extracting said at least one unit pharmaceutical product from said receiving element by tearing or removing a covering element fixed to said receiving element in the region of an orifice into which said internal space of said cell opens, the cell then being open;

dividing said unit pharmaceutical product into a number of fractions, with at least one fraction being intended to be taken and at least one other fraction being intended to be kept;

placing said fraction to be kept back into said previously opened cell;

removing a repositionable temporary closure member of said packaging, having a closure portion at least partially coated with adhesive, from its predetermined initial position; and repositioning said repositionable temporary closure member in its temporary closure position in which said closure member is temporarily fixed by adhering to said receiving element around said orifice into which said internal space of said previously opened cell opens; said closure position being different than said predetermined initial position.

* * * * *